US008396381B2

(12) United States Patent
Heid et al.

(10) Patent No.: US 8,396,381 B2
(45) Date of Patent: Mar. 12, 2013

(54) METHODS AND APPARATUSES FOR APPLYING RESPECTIVE EP ENGINE SETTINGS TO DIFFERENT ZONES WITHIN A PAGE OF MEDIA

(75) Inventors: Matthew D. Heid, Simpsonville, KY (US); Kevin Dean Schoedinger, Lexington, KY (US); David John Mickan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 435 days.

(21) Appl. No.: 12/618,444

(22) Filed: Nov. 13, 2009

(65) Prior Publication Data

US 2011/0116817 A1 May 19, 2011

(51) Int. Cl.
*G03G 15/00* (2006.01)

(52) U.S. Cl. ..... 399/38; 399/81

(58) Field of Classification Search ..... 399/38, 399/51, 66, 67, 69, 81, 82, 85; 347/240, 347/251–254
See application file for complete search history.

(56) References Cited

U.S. PATENT DOCUMENTS 6,480,688 B1 * 11/2002 Yasui ..... 399/85
7,676,171 B2 * 3/2010 Swantner et al. ..... 399/85

* cited by examiner

*Primary Examiner* — William J Royer

(57) ABSTRACT

Generally, an imaging device is capable of applying respective EP engine settings to different zones within a page of media. In an example embodiment, a method includes printing in first and second zones on a page of media using first and second EP engine settings that are respectively associated with the first and second zones. The imaging device prints in the first zone on the page of media based on a first EP engine setting that is associated with the first zone. The imaging device switches from the first zone on the page of media to the second zone on the page of media responsive to a size indicator. The imaging device prints in the second zone on the page of media based on a second EP engine setting that is associated with the second zone.

33 Claims, 11 Drawing Sheets

METHODS AND APPARATUSES FOR APPLYING RESPECTIVE EP ENGINE SETTINGS TO DIFFERENT ZONES WITHIN A PAGE OF MEDIA

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

This description relates generally to imaging devices and their operation, and more specifically but by way of example and not limitation, to enabling imaging devices to apply respective print settings to different zones within a page of media. For electrophotographic (EP) types of imaging devices, respective EP engine settings may be applied to different zones within a page of media.

2. Description of the Related Art

Imaging devices are deployed in many different situations, such as industrial, business, educational, home, and other environments. Imaging devices include, but are not limited to, printers, copiers, multi-function devices, fax machines, combinations thereof, and the like. They can be used, for example, to create a so-called "hard copy" of an image on one or more pages of media.

To create an image on a page of media, most imaging devices either transfer some type of substance to the media or transform portions of specially-formulated media. For example, some imaging devices transfer substances such as toner, ink, and the like to a page of media to create the image. The substance may be stored in or on a drum, cartridge, container, compartment, ribbon, or some other structure. Other imaging devices change the physical properties of the media, such as by using heat in a thermal process, to create the image.

When printing, imaging devices tend to consume supplies. The supplies that are being consumed may be substances being transferred to the page of media, the media itself, both the substance and the media, and the like. Each imaging device also consumes a supply of power while in operation. The substances being transferred, the pages of the media, the power, and the like that are consumed during operation of an imaging device are an ongoing expense for the owner and operator of the device. Consequently, users are generally enthusiastic about adopting and employing technologies that enable them to reduce their level of consumption of any of these supplies when using imaging devices.

SUMMARY

Generally, an imaging device is capable of applying respective electrophotographic (EP) engine settings to different zones within a page of media. In an example embodiment, a method includes printing in first and second zones on a page of media using first and second EP engine settings that are respectively associated with the first and second zones. The imaging device prints in the first zone on the page of media based on a first EP engine setting that is associated with the first zone. The imaging device switches from the first zone on the page of media to the second zone on the page of media responsive to a size indicator. The imaging device prints in the second zone on the page of media based on a second EP engine setting that is associated with the second zone.

In another example embodiment, an imaging device is capable of applying respective EP engine settings to different zones within a page of media. The imaging device includes at least one input interface, a print mechanism, and a controller. The at least one input interface is to receive printing information for a page of media. The printing information includes a size indicator for at least one zone of multiple zones within the page of media and one or more respective EP engine settings for the multiple zones within the page of media. The print mechanism is to print on the page of media. The controller is to utilize the printing information to print on the page of media by controlling the print mechanism. The controller is to cause the print mechanism to print on the page of media in a first zone using a first EP engine setting and to print on the page of media in a second zone using a second EP engine setting. The controller is to establish a boundary between the first zone and the second zone responsive to the size indicator.

In yet another example embodiment, one or more processor-accessible storage media have processor-executable instructions to facilitate applying respective EP engine settings to different zones within a page of media. The processor-executable instructions, when executed, configure a device to perform multiple acts. A user interface is provided that enables a user to establish at least a first zone and a second zone of a page of media. At least one size indicator that defines a boundary between the first zone and the second zone on the page of media is accepted from the user. One or more EP engine settings that are to be associated with the first zone of the page of media are ascertained. One or more EP engine settings that are to be associated with the second zone of the page of media are ascertained.

Additional embodiments are described and/or claimed herein. Example additional embodiments include, by way of example but not limitation, arrangements, systems, other memories, other apparatuses and devices, other methods, and the like. Additional aspects are set forth in part in the Detailed Description, Drawings, and Claims that follow, and in part may be derived from the Detailed Description and Drawings, or can be learned by practice of the teachings herein. It is to be understood that both the foregoing general description and the following Detailed Description are exemplary and explanatory only and are not restrictive of the invention as disclosed or as claimed.

BRIEF DESCRIPTION OF THE DRAWINGS

A more complete understanding may be obtained by reference to the following Detailed Description when taken in conjunction with the accompanying Drawings wherein.

DETAILED DESCRIPTION

Figure 1:
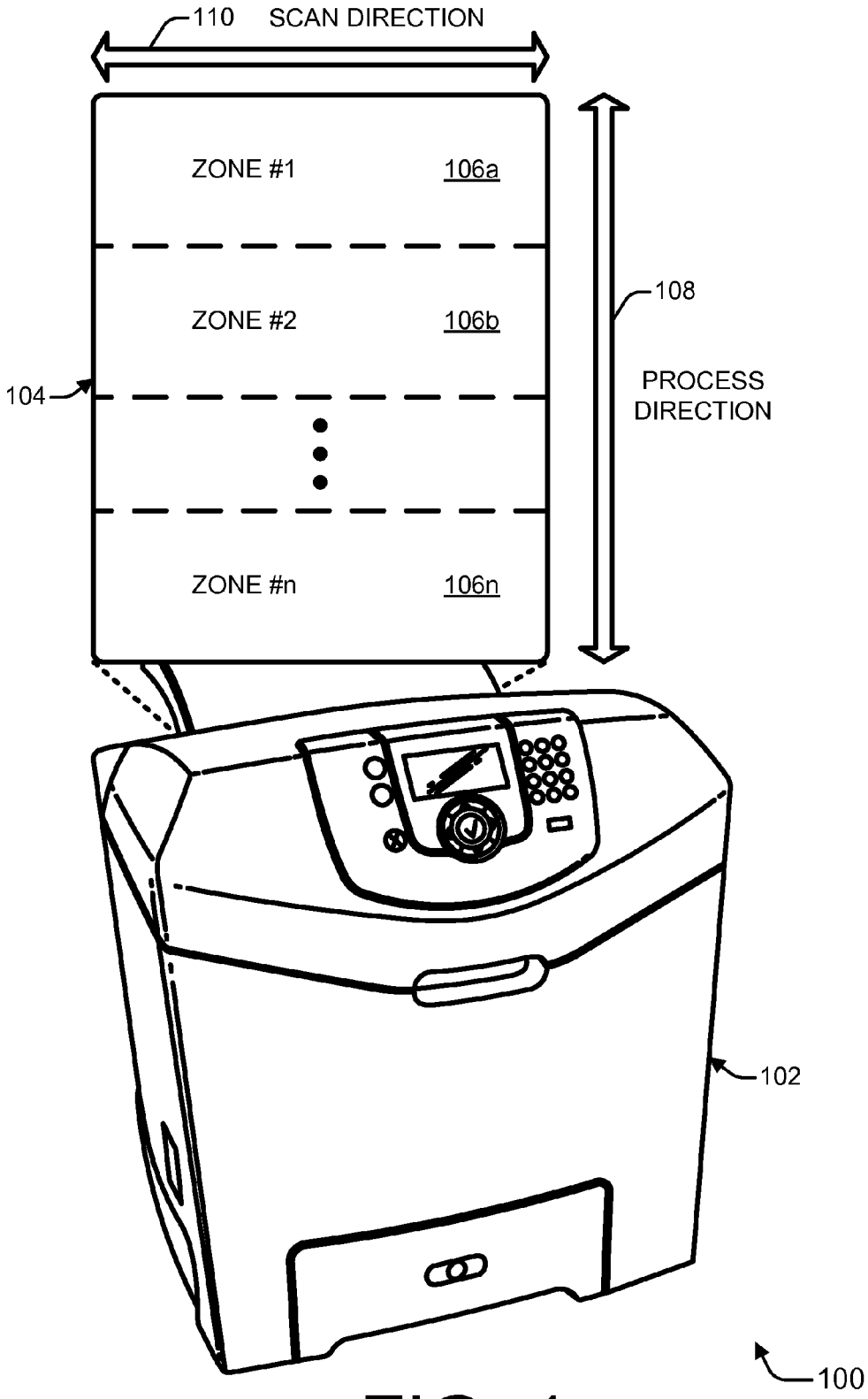
FIG. 1 depicts an imaging device and an example page of media having multiple zones.

It is to be understood that the invention is not limited in its application to the details of construction and the arrangement of components set forth in the following description or illustrated in the Drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

As described herein above, operation of an imaging device consumes supplies. These supplies include substances transferred to media, pages of media, power, and the like. Because consumption of these supplies is an ongoing cost, reduction in their consumption can reduce operational expenses for imaging devices. Adoption and implementation of certain embodiments that are described herein may reduce the consumption of one or more of these supplies, which can save users money during the operation of their imaging devices, as well as potentially create less waste. Moreover, certain embodiments offer users additional options and flexibility that have not heretofore been available for tailoring their printing.

In example embodiments, an imaging device is capable of printing image data over multiple zones within a page of media using different respective print settings, such as electrophotographic (EP) engine settings, in different respective zones. For example, two zones on a page of media may be separated by a boundary that is defined by at least one size indicator. The different respective print settings per zone empower a user to print in a first zone using a first print setting and to print in a second zone using a second print setting.

Example print settings are as follows: A first print setting may correspond to, for instance, printing at a first, relatively darker setting. A second print setting may correspond to printing at a second, relatively lighter setting. In this manner, a user may provide relatively dark images in one zone while reducing the use of transferred substances in the other lighter zone to thereby lower expenses. Alternatively, a first print setting may correspond to, for instance, printing on a first type of media on a page of media. A second print setting may correspond to printing on a second type of media on the page of media. In this manner, a single sheet of media may be printed on to a desired level of quality when a user wishes to print on two different media types and does not need (or want) to use two entirely separate pages of media. As another alternative, a first print setting may correspond to, for instance, printing at a first "fundamental" resolution on a page of media. A second print setting may correspond to printing at a second "fundamental" resolution on the page of media. Other print settings may also be implemented.

Print settings that are adjustable, especially with regard to the operation of an imaging device, may vary in dependence on the type of printing mechanism employed. There are many different types of printing mechanisms, such as those pertaining to EP printing mechanisms, inkjet printing mechanisms, and the like. By way of example to illustrate certain principles but not by way of limitation, many of the examples provided herein below pertain to EP printing mechanisms. Thus, print settings may comprise EP engine settings for an EP engine of an EP printing mechanism. EP engine settings for the EP engine may be adjusted in different zones within a single sheet of media. Examples of user-perceived EP engine settings include, but are not limited to, darkness/lightness settings, media type settings (e.g., thickness/weight, texture, and the like), print quality, visual resolution, combinations thereof, and the like. Examples of print-mechanism-related EP engine settings include, but are not limited to, laser intensity level, transfer voltage level, fuser temperature, fundamental resolution, developer voltage, charge voltage, combinations thereof, and the like.

FIG. 1 depicts an imaging device 102 and an example page of media 104 having multiple zones 106*a*, 106*b* . . . 106*n*. As illustrated, block diagram 100 includes an example imaging device 102 and example output of a page of media 104. The direction that page of media 104 is fed through imaging device 102 is termed herein a process direction 108. The other direction of page of media 104 is termed herein a scan direction 110.

As shown in FIG. 1, scan direction 110 is along the shorter edge of page of media 104. Process direction 108 is along the longer edge of page of media 104. However, this is merely an example approach to feeding sheets of media through an imaging device. A longer edge of a page of media may alternatively be fed first into an imaging device. In such an (unillustrated) alternative, scan direction 110 would be along the longer edge of the page of media, and process direction 108 would be along the shorter edge of the page of media. For the sake of consistency and clarity, but by way of example only, the remainder of this description focuses on process and scan directions 108 and 110 that match those that are illustrated in block diagram 100.

In an example embodiment, multiple zones 106*a*, 106*b* . . . 106*n* are defined on and/or included as part of page of media 104. As illustrated, "n" zones 106*a*, 106*b* . . . 106*n* are included on page of media 104, with "n" representing a positive integer. Each respective zone may be associated with its own respective EP engine setting(s). Although each zone 106*a*, 106*b* . . . 106*n* in block diagram 100 is shown as being of the same size, different zones 106*a*, 106*b* . . . 106*n* may alternatively have different sizes (or shapes).

Figure 2A:
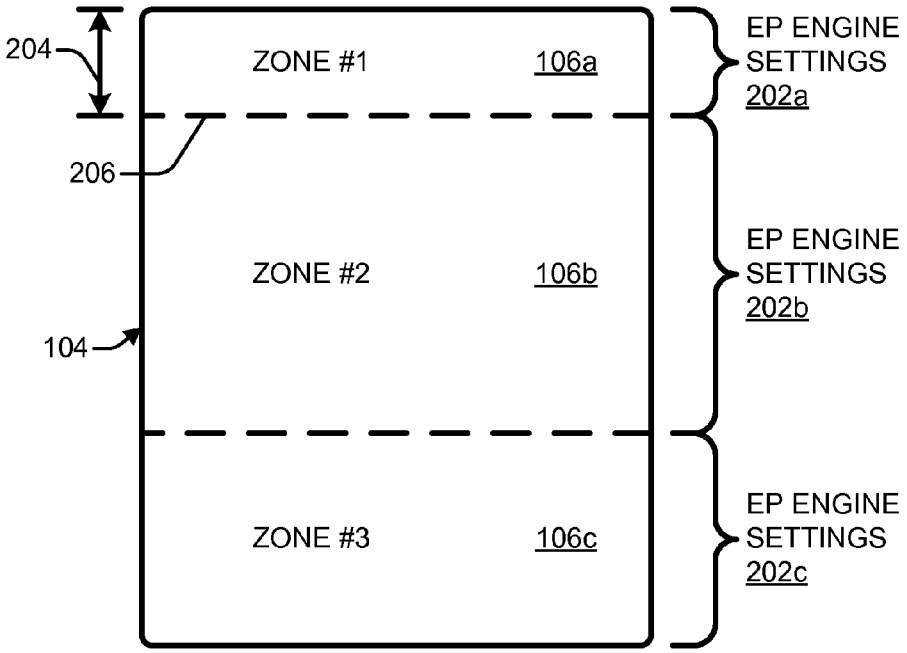
FIGS. 2A and 2B illustrate pages of media having example layouts for multiple zones.
Figure 2B:
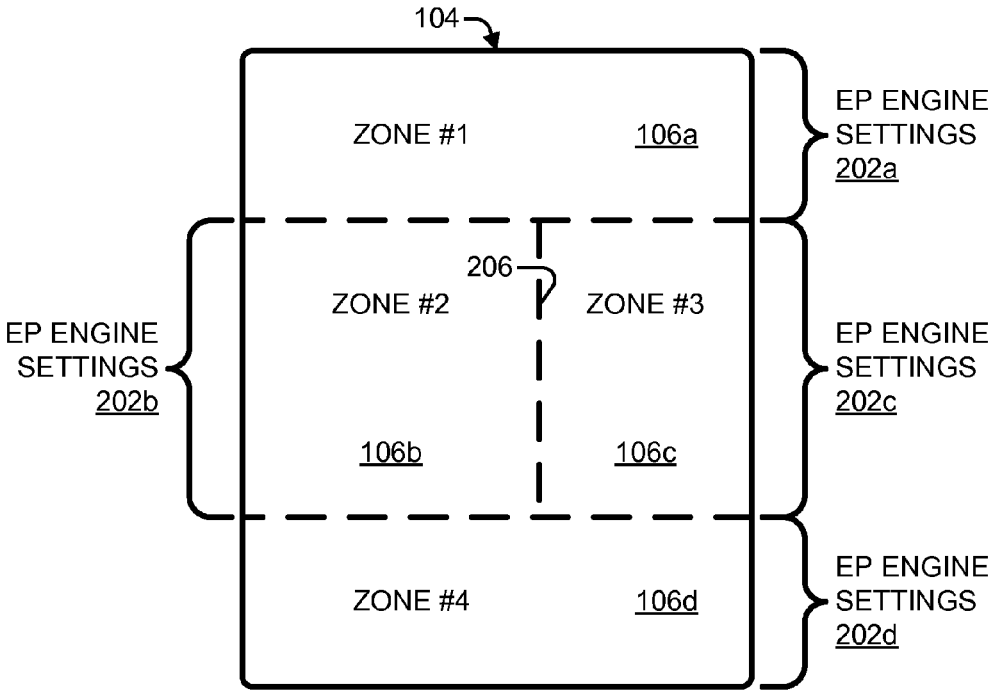

FIGS. 2A and 2B illustrate pages of media 104 having example layouts for multiple zones. In FIG. 2A, page of media 104 includes three zones: first zone #1 106*a*, second zone #2 106*b*, and third zone #3 106*c*. Each zone is associated with at least one respective EP engine setting. As illustrated, zone 106*a* is associated with EP engine settings 202*a*, zone 106*b* is associated with EP engine settings 202*b*, and zone 106*c* is associated with EP engine settings 202*c*.

In an example embodiment, first zone 106*a* is the smallest of the three zones. Second zone 106*b* is the largest zone, and third zone 106*c* is a middle-sized zone. The boundary (e.g., a dashed line boundary 206) between any two zones may be defined or established responsive to a size indicator (e.g., a size indicator 204). A size indicator may be, for example, a distance measured on page of media 104. The distance may be measured relative to an edge of page of media 104. For instance, the distance defining a beginning (e.g., a leading edge of a page or zone for boundaries parallel to the scan direction) or an ending location (e.g., a trailing edge of a page or zone for boundaries parallel to the scan direction) for one or more of zones may be measured relative to a leading edge of page of media 104 as it is fed into an imaging device. Alternatively, the distance may be measured relative to the location of an object (e.g., a text, a picture, a colored area, or other content) that is being printed on a page of media.

Also, the distance defining a beginning or ending location for one or more zones may be measured relative to another zone boundary, such as the end of a previous zone. Alternatively, the distance defining a beginning or ending location for one or more zones may be measured relative to an object to be printed. Each zone and/or a boundary thereof may be defined with a beginning size indicator, an ending size indicator, or both a beginning and an ending size indicator. Size indicators may also be implemented differently from those examples described above or otherwise herein below.

In FIG. 2B, page of media 104 includes four zones: first zone #1 106*a*, second zone #2 106*b*, third zone #3 106*c*, and fourth zone #4 106*d*. Each zone is associated with at least one respective EP engine setting. As illustrated, zone 106*a* is associated with EP engine settings 202*a*, zone 106*b* is associated with EP engine settings 202*b*, zone 106*c* is associated with EP engine settings 202*c*, and zone 106*d* is associated with EP engine settings 202*d*.

As shown in other drawings and as otherwise described herein, zones are separated by boundaries that run along or are parallel to the scanning direction so as to be perpendicular to the process direction. Alternatively, zones may be separated by boundaries that run along the process direction so as to be perpendicular to the scanning direction. An example of a page of media 104 that includes at least one zone boundary that is defined parallel to the process direction is shown in FIG. 2B. Although only one such boundary (i.e., the boundary between zones 106*b* and 106*c*) is shown, multiple boundaries that are parallel to the process direction may be defined on a single page of media. Also, such a boundary may extend the entire length of a page of media along the process direction. Other layouts may alternatively be implemented with any combination of one or more boundaries in one direction or in both directions.

In an example embodiment, boundary 206 between zones 106*b* and 106*c* is defined to be parallel to the process direction. In such an implementation, either or both of second and third zones 106*b* and 106*c* may include size indicators along two directions. For instance, second zone 106*b* may be defined by a size indicator that is relative to the leading edge of page of media 104 and another size indicator that is relative to a side edge of page of media 104. For the sake of consistency and clarity, but by way of example only, the remainder of this description focuses on zones having boundaries that are defined parallel to the scanning direction.

Figure 3A:
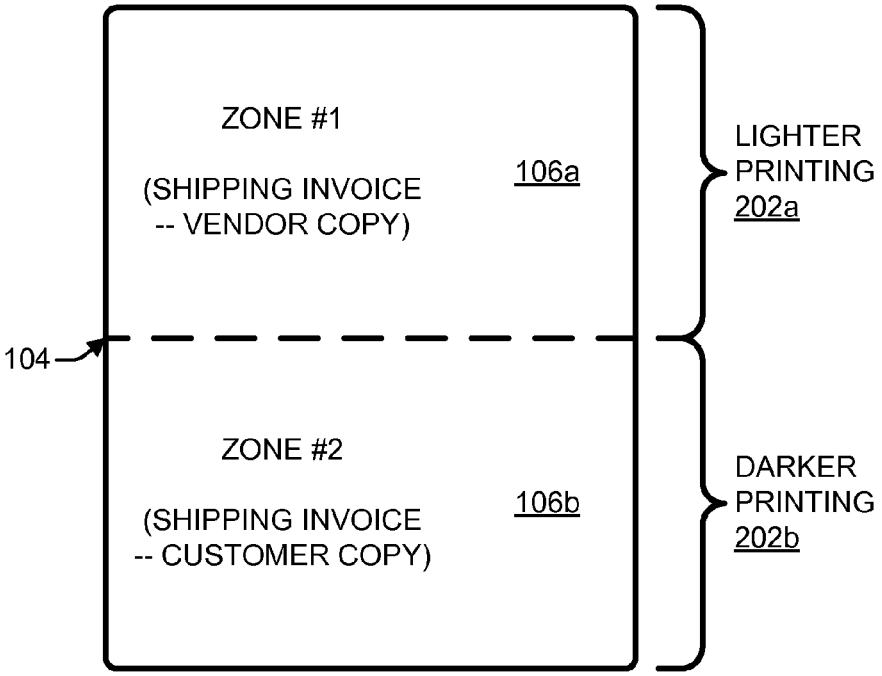
FIGS. 3A, 3B, and 3C illustrate pages of media having example EP engine setting usage implementations for multiple zones.
Figure 3B:
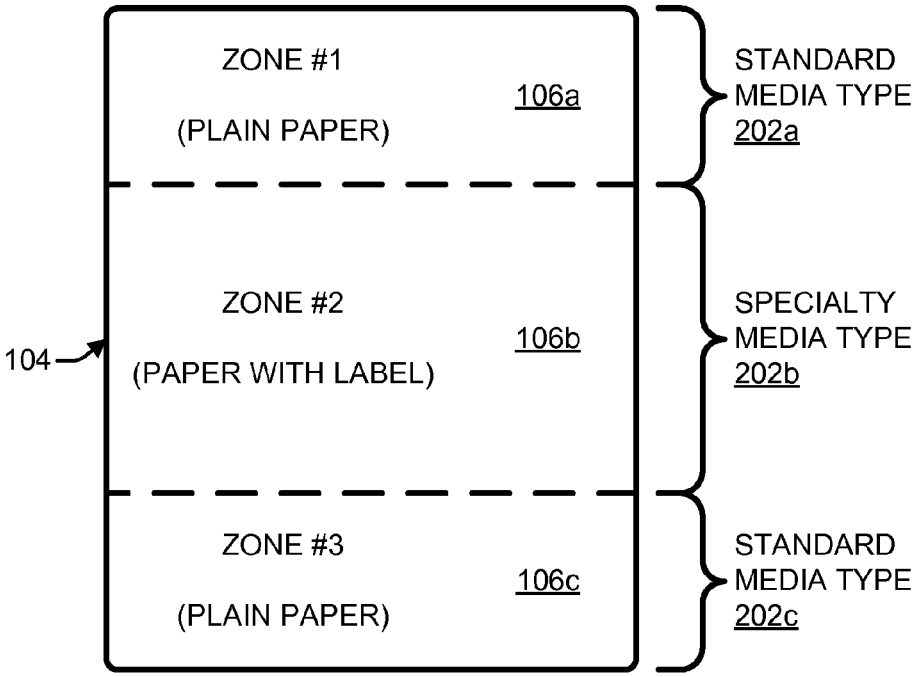
Figure 3C:
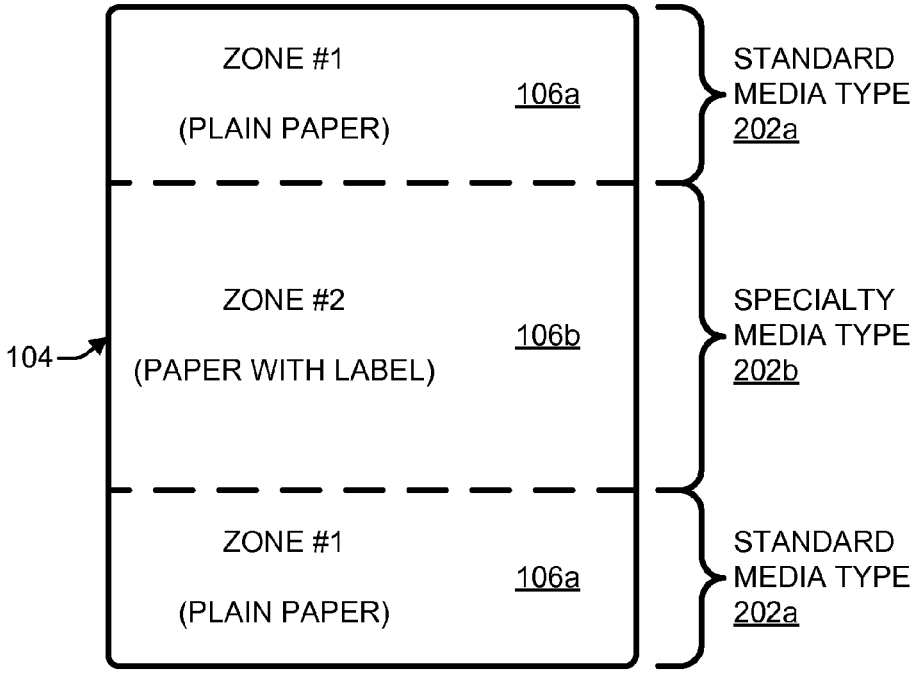

FIGS. 3A, 3B, and 3C illustrate pages of media 104 having example printer setting usage implementations for multiple zones. Each page of media 104 in FIGS. 3A, 3B, and 3C shows an example implementation in which a user may wish to establish different EP engine settings in respective different zones. These example EP engine setting implementations are also used to describe example approaches to realizing user-perceived EP engine settings within a print mechanism of an imaging device. In other words, example print mechanism EP engine settings are described that correspond to example user-perceived EP engine settings.

In FIG. 3A, a page of media 104 is intended for two uses: as a vendor copy of a shipping invoice, which is designated as a first zone 106*a*; and as a customer copy of the shipping invoice, which is designated as a second zone 106*b*. The vendor wishes to provide its customer with a dark, easy-to-read shipping invoice. In contrast, the vendor wishes to print its shipping invoice in a lighter format in order to save costs. Hence, first zone 106*a* is assigned and associated with a lighter printing EP engine setting 202*a*, and second zone 106*b* is assigned and associated with a darker printing EP engine setting 202*b*. Different darkness/lightness settings within a page of media may also be selected by a vendor if the page of media itself already has different coloring and/or shading. In operation, the vendor user of the imaging device may be provided some user interface to set the desired level of darkness/lightness for the printed images in each zone.

After the user has set respective desired levels of printing darkness 202*a*, 202*b*, the print mechanism of an imaging device is to implement this darkness on different respective zones 106*a*, 106*b* of page of media 104. For a laser printer or other imaging device that employs an EP printing mechanism, the darkness of the printed image may be controlled by changing the intensity of the laser (e.g., in a laser printer cartridge of an EP engine). Thus, a lighter printing EP engine setting 202*a* is converted to a lower laser intensity EP engine setting 202*a*, and darker printing EP engine setting 202*b* is converted to a higher laser intensity EP engine setting 202*b*.

For an inkjet imaging device, a user may set the printing mode quality. For instance, the printing mode quality may be established to be draft mode, standard mode, best mode, and the like. The darkness and/or mode quality of the printed image may be controlled, for example, by changing the size of the ink droplets (e.g., by changing the amount of ink that is sprayed or ejected from the nozzle) and/or the spacing of the dots that are created on the page by the ink droplets. Other printing mechanisms for other types of imaging devices may similarly control the darkness setting of printed images. When zone boundaries are established parallel to a process direction (e.g., as for second and third zones 106*b* and 106*c* in FIG. 2B) for a laser-based imaging device, laser intensity may be controlled separately in the separate zones via (e.g., separate) current control pins on the printhead.

In FIG. 3B, a page of media 104 is intended for three uses: the top and bottom portions are to be used as plain paper, which are designated as first and third zones 106*a* and 106*c*; and the middle portion is to be used as a mailing label, which is designated as a second zone 106*b*. A vendor wishes to print general customer or order information on the same page as a mailing label. Hence, first and third zones 106*a* and 106*c* are assigned and are associated with standard media type EP engine settings 202*a* and 202*c*. Second zone 106*b*, on the other hand, is assigned and associated with a specialty media type EP engine setting 202*b*. In operation, the vendor user of the imaging device may be provided some user interface enabling the setting of the media type for the page of media in each defined zone.

After the user has set respective media types 202*a*, 202*c* and 202*b*, the print mechanism of an imaging device is to appropriately tailor the printing on different respective zones 106*a*, 106*c* and 106*b* of page of media 104. For an imaging device that employs an EP engine as part of an EP printing mechanism, different media types may be handled, for example, by changing the transfer voltage (e.g., of the transfer roller) and/or by changing the fuser temperature. Thus, a standard media type EP engine setting 202*a*, 202*c* may be converted to a standard transfer voltage EP engine setting 202*a*, 202*c*, and a specialty media type EP engine setting 202*b* may be converted to a higher or lower transfer voltage EP engine setting 202*b* (e.g., depending on media texture). Other printing mechanisms for other types of imaging devices may similarly control the print settings for different media types.

More specifically, EP print settings for an EP engine of an EP print mechanism may be changed with regard to, by way of example but not limitation, laser intensity level, transfer voltage level, fuser temperature, some combination thereof, and the like. As described above, increasing a laser intensity level can increase a darkness of printed images (including text), and decreasing a laser intensity level can decrease a darkness of printed images (i.e., lighten the printed image). With regard to transfer voltage level, it is typically changed based, at least partly, on media texture to attain a desired image quality. For example, a transfer voltage may be increased for media having a relatively rougher texture, and the transfer voltage may be decreased for media having a relatively smoother texture. With regard to fuser temperature, it is typically changed based, at least partly, on media thickness (which may be related to media weight as well). For example, a relatively higher fuser temperature is used for a relatively thicker media (e.g., media with a heavier weight, media having a label, and the like), and a relatively lower fuser temperature is used for a relatively thinner (including lighter weighted) media. With regard to developer voltage and charge voltage, they are typically changed individually and/or jointly to affect print darkness.

Another example EP engine setting relates to resolution, which may be measured in terms of dots per inch (DPI), including lines per inch. Some EP print mechanisms can print at different DPIs (e.g., 300, 600, 1200, and the like). Higher DPIs may correlate to higher quality imaging results and/or may possibly correlate to darker imaging results, but higher DPIs may also at times consume more toner or other printing substance. Thus, a user/customer may wish to print at different DPIs within a single sheet of media. This may be enabled by selecting a first DPI in a first zone and a second DPI in a second zone. These different DPI resolutions may be termed standard, draft, photo, good, better, best, and the like.

FIG. 3B is described in terms of three different zones 106*a*, 106*b*, and 106*c*. Zone 106*a* and zone 106*c* are assigned a standard media type 202*a* and 202*c*, respectively. Instead of a third zone 106*c* being defined on page of media 104, the zone assignments may instead be implemented and/or be considered as reverting back to a "previous" zone on the page. In FIG. 3C, such an example is illustrated. A page of media 104 includes first and second zones 106*a* and 106*b*. First zone 106*a*, however, is effectively "partitioned" into two different portions by second zone 106*b*. Hence, at the end of second zone 106*b*, the EP engine settings of first zone 106*a*, which correspond to standard media type 202*a* in the illustrated example of FIG. 3C, may be continued and/or reactivated.

A single sheet of media may, in other situations, include multiple parts and/or uses. Thus, other printer setting usage implementations for multiple zones are provided below. Examples include, but are not limited to, pharmacy labels, dual-web labels (e.g., a combined shipping label and packing slip), hospital wristbands, department of motor vehicles (DMV) registration cards/labels, railway multipart cards, letter/envelope combined media, radio frequency identification (RFID)-embedded labels, other dual web media, and the like.

Figure 4:
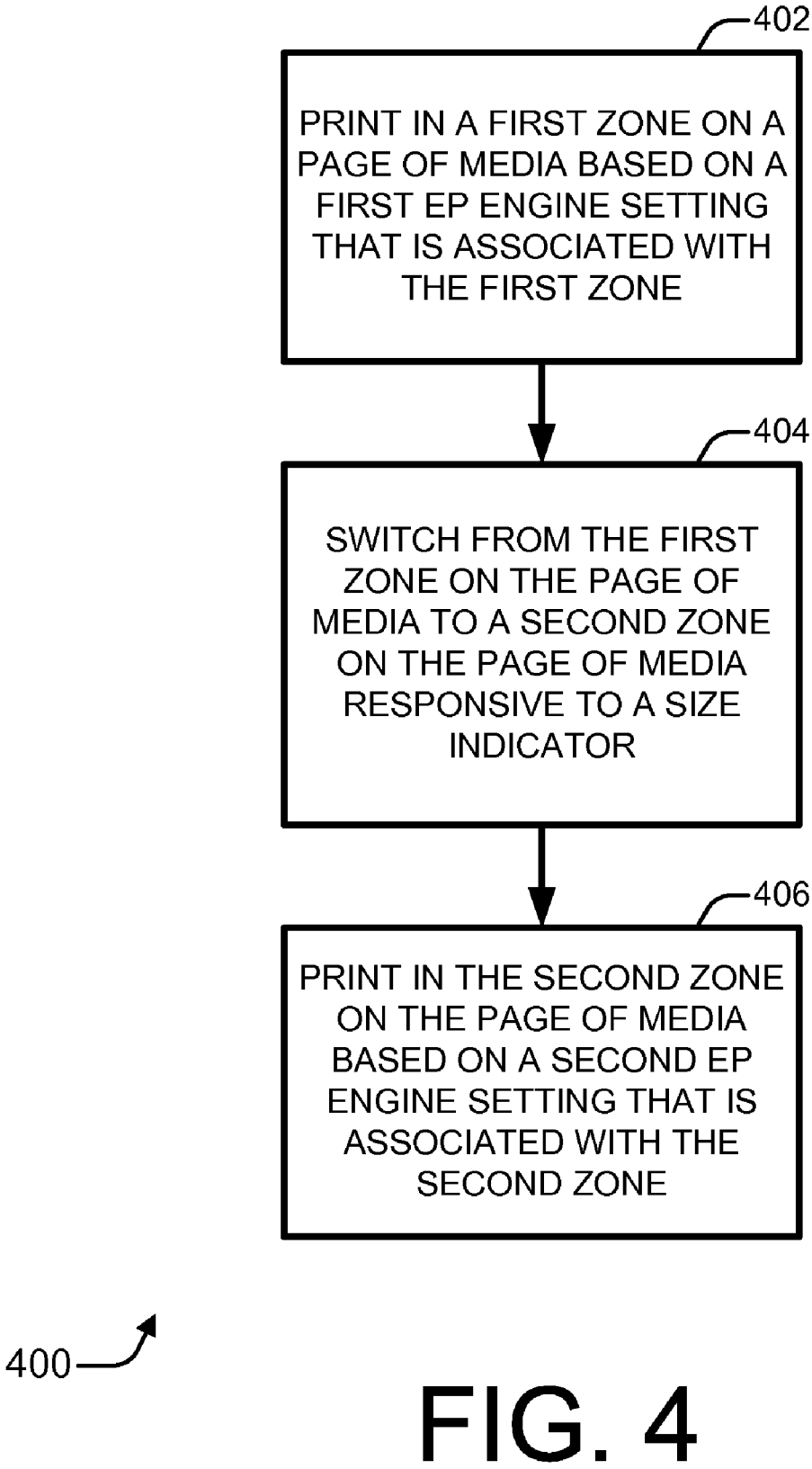
FIG. 4 is a flow diagram of an example method for applying respective EP engine settings to different zones within a page of media.

FIG. 4 is a flow diagram 400 of an example method for applying respective EP engine settings to different zones within a page of media. As illustrated, flow diagram 400 includes three blocks 402, 404, 406. For example embodiments, an imaging device is capable of applying respective EP engine settings to different zones within a page of media. At block 402, an imaging device prints in a first zone on a page of media based on a first EP engine setting that is associated with the first zone. For example, an imaging device 102 may print in a first zone 106*a* on a page of media 104 based on a first EP engine setting 202*a* that is associated with first zone 106*a*.

At block 404, the imaging device switches from the first zone on the page of media to a second zone on the page of media responsive to a size indicator. For example, imaging device 102 may switch from first zone 106*a* to a second zone 106*b* on page of media 104 responsive to a size indicator 204 that defines a boundary 206. In an example implementation, as part of the switching, imaging device 102 may adjust operation of an EP print mechanism thereof to accommodate a switching from the first EP engine setting to the second EP engine setting as page of media 104 is advanced to a distance corresponding to size indicator 204. At block 406, the imaging device prints in the second zone on the page of media based on a second EP engine setting that is associated with the second zone. For example, imaging device 102 may print in second zone 106*b* on page of media 104 based on a second EP engine setting 202*b* that is associated with second zone 106*b*.

Figure 5:
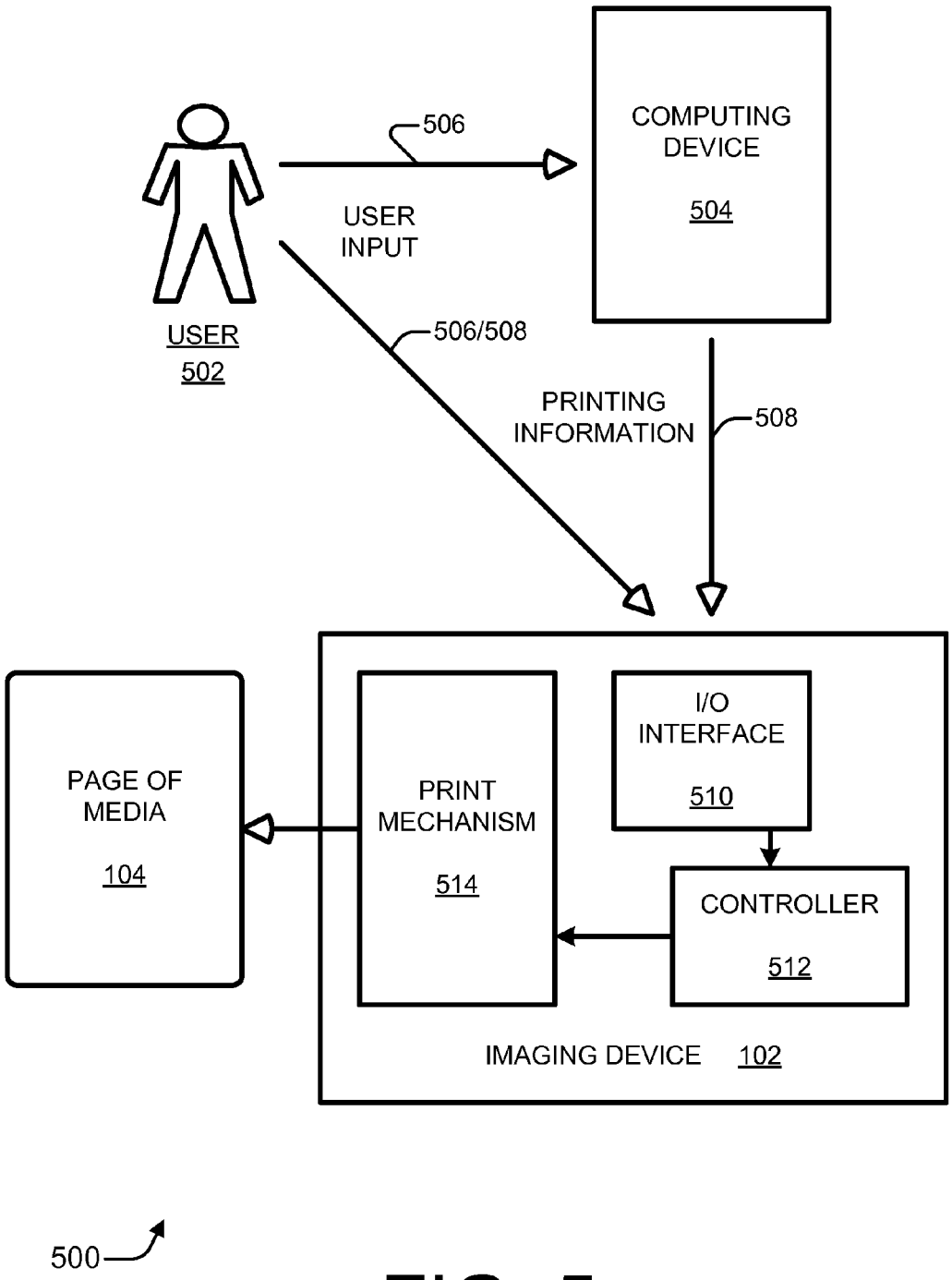
FIG. 5 is a block diagram of an example imaging device in an operational imaging system.

FIG. 5 is a block diagram of an example imaging device 102 in an operational imaging system 500. As illustrated, example imaging system 500 includes an imaging device 102 and a computing device 504. Also illustrated are a user 502 and a page of media 104. In an example embodiment, imaging device 102 includes an input and/or output interface 510, a controller 512, and a print mechanism 514. The block diagram of FIG. 5 also shows user input 506 and printing information 508.

In an example operation, user 502 provides user input 506 to computing device 504. User input 506 may be entered, e.g., via an application plug-in corresponding to an imaging device and/or via an imaging device driver that is executing on computing device 504. Computing device 504 is to combine user input 506 with other printing data to create printing information 508. After the combining, computing device 504 sends printing information 508 to imaging device 102 via I/O interface 510. Printing information 508 is then used to produce an image or images on page of media 104.

I/O interface 510 may be a wired and/or wireless interface, as well as a direct or network interface. There may also be other intervening networks and/or equipment between imaging device 102 and computing device 504. I/O interface 510 may also be a user-accessible interface for imaging device 102, such as a keyboard, keypad, touchpad, display screen, touch screen, some combination thereof, and the like. Hence, user 502 may alternatively enter user input 506 (e.g., which would also form at least part of printing information 508) directly to imaging device 102 via such a user-accessible I/O interface 510. Furthermore, I/O interface 510 may be a scanner that scans in at least a portion of printing information 508.

Controller 512 includes control instructions (not explicitly shown in FIG. 5) that operate imaging device 102. The control instructions may be realized as fixed logic circuitry, hardware, firmware, software, some combination thereof, and the like. In an example implementation, controller 512 is capable of converting a size indicator into a distance indicator on the page of media that is in a type of units that is understood by print mechanism 514. Print mechanism 514 may understand human-level measurements (e.g., inches, millimeters, and the like), counts on an encoder, some other specialized units, and the like. In another example implementation, when an e.g. EP engine setting is provided to an imaging device in a user-perceived EP engine setting format, controller 512 is to convert such user-perceived EP engine settings into at least one print mechanism EP engine setting that is understood by print mechanism 514. For instance, a user-perceived EP engine setting of a thick media may be converted into a print mechanism EP engine setting of a particular corresponding fuser temperature.

For example embodiments, imaging device 102 is capable of applying respective print settings (e.g., EP engine settings) (of FIGS. 2A, 2B, 3A-3C) to different zones (of FIGS. 1, 2A, 2B and 3A-3C) within a page of media 104. Imaging device 102 includes at least one input interface (e.g., I/O interface 510), a controller 512, and a print mechanism 514. The input interface is to receive printing information (e.g., printing information 508) for a page of media, with the printing information including at least one size indicator (e.g., a size indicator 204) for at least one zone of multiple zones within the page of media and one or more respective EP engine settings for each zone of the multiple zones within the page of media. Printing information, which may include printing data and/or EP engine settings, may be provided to the input interface(s) at different times or partially or fully simultaneously. They may also be provided from the same source or from different sources.

The print mechanism (e.g., an EP print mechanism) is to print on the page of media. The controller is to utilize the printing information to print on the page of media by controlling the print mechanism. The controller is to cause the print mechanism to print on the page of media in a first zone using a first EP engine setting and to print on the page of media in a second zone using a second EP engine setting. The controller is to establish a boundary (e.g., a boundary 206) between the first zone and the second zone responsive to the size indicator.

Print mechanism 514 may be implemented differently depending on the type of imaging device 102 in which it is deployed. Example types of imaging devices 102 include, but are not limited to, EP (e.g., laser, light emitting diode (LED), liquid crystal display (LCD) plus light source, magneto-optic array plus light source, cathode ray tube (CRT) with fiber optics, or other toner-based) printing types, liquid ink (e.g., inkjet) printing types, dot matrix printing types, thermal printing types, solid ink printing types, dye-sublimation types, combinations of such types, and the like. An EP print mechanism may include an EP engine. By way of example, laser printing imaging devices usually include an imaging area and a fuser. The imaging area typically includes a printer cartridge, a photo conductor drum, and a transfer voltage roller. The fuser melts the toner onto the media. The fuser may be configured for different media type zones in dependence on the width (including weight) of the media type (e.g., thick/heavy versus thin/light).

Figure 6:
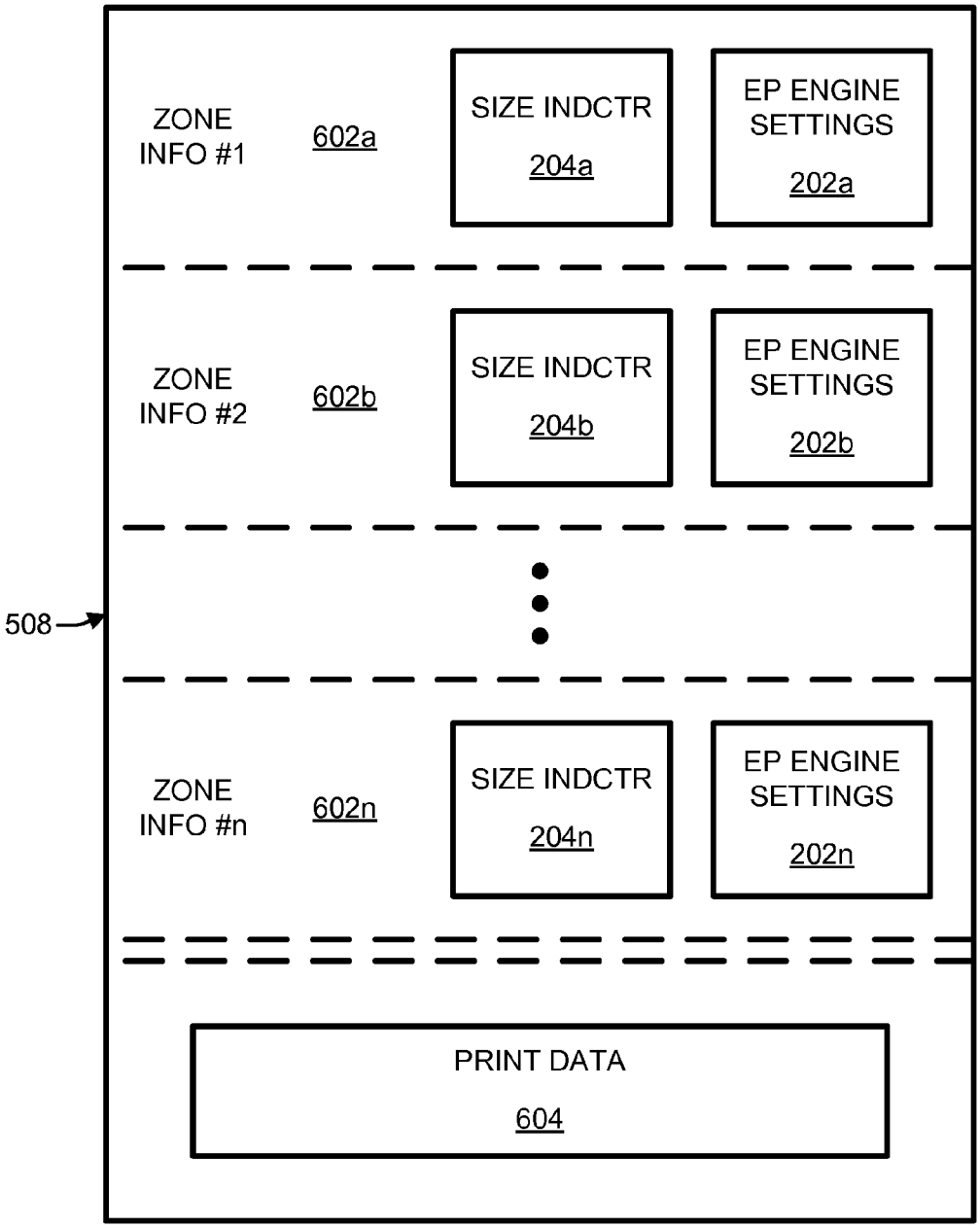
FIG. 6 is a block diagram of example printing information, such as that shown in FIG. 5, that includes zone information.

FIG. 6 is a block diagram of example printing information 508 (such as the printing information shown in FIG. 5) that includes zone information. Respective zone information is associated with each respective zone (of FIGS. 1, 2A, 2B, and 3A-3C). As illustrated, printing information 508 includes zone information 602*a*, 602*b* . . . 602*n* for multiple zones, multiple size indicators 204*a*, 204*b* . . . 204*n*, multiple EP engine settings 202*a*, 202*b* . . . 202*n*, and print data 604. In an example embodiment, respective zones 106*a*, 106*b* . . . 106*n* (not shown in FIG. 6) are associated with respective zone information 602*a*, 602*b* . . . 602*n*. Each zone information includes at least one size indicator 204 and one or more EP engine settings. For instance, zone information 602*a*, which corresponds to a first zone 106*a*, includes at least one size indicator 204*a* and one or more EP engine settings 202*a*. Printing information 508 may also include print data 604 that forms the image(s) to be printed. Print data 604 may be located together (as shown) or distributed, such as across respective zones of information. In alternative embodiments, printing information 508 may be organized differently and/or include different information than that which is shown in FIG. 6 and/or described herein.

Figure 7:
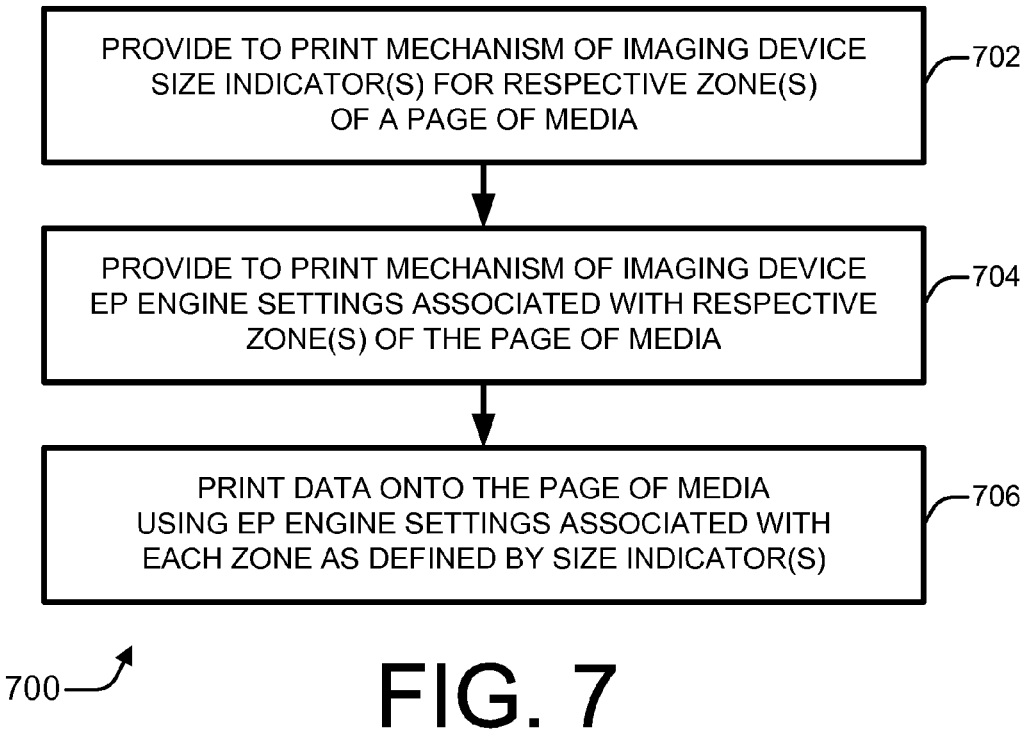
FIG. 7 is a flow diagram of an example method for applying respective EP engine settings to different zones within a page of media in the context of an imaging device, such as that of FIG. 5.

FIG. 7 is a flow diagram 700 of an example method for applying respective EP engine settings to different zones within a page of media in the context of an imaging device, such as the one illustrated in FIG. 5. As illustrated, flow diagram 700 includes three blocks 702, 704, 706. In an example embodiment, at block 702, at least one size indicator for a zone of a page of media is provided to a print mechanism of an imaging device. At block 704, one or more EP engine settings associated with respective zones of the page of media are provided to the print mechanism of the imaging device. At block 706, data is printed onto the page of media using the EP engine settings that are associated with each zone, with at least one zone being defined by the size indicator.

As noted herein above, for boundaries that are parallel to the scan direction, a second zone can be defined at some point from the leading edge until the trailing edge, or the second zone can be defined as a band between the leading and trailing edges. A specific example approach to implementing a dual zone scenario in which image darkness EP engine settings may be adjusted is provided below. Data can be passed to EP engine firmware as 3 bytes with the following example definition: Byte 1=start of second zone (e.g., mm from leading edge, 0 corresponds to being disabled); Byte 2=end of second zone (e.g., mm from start of second zone, 0 corresponds to trailing edge of media); and Byte 3=toner darkness level of second zone and which source to apply this zone (e.g., 0 means no adjustment, and the other bits are encoded to represent second zone darkness (1-10) and which tray(s) is enabled). As with some other EP-engine-related commands, the zones may be defined on an imaging device using EP engine settings values, remotely using a, e.g., printer job language (P JL) header in the datastream, some combination thereof, and the like.

Figure 8:
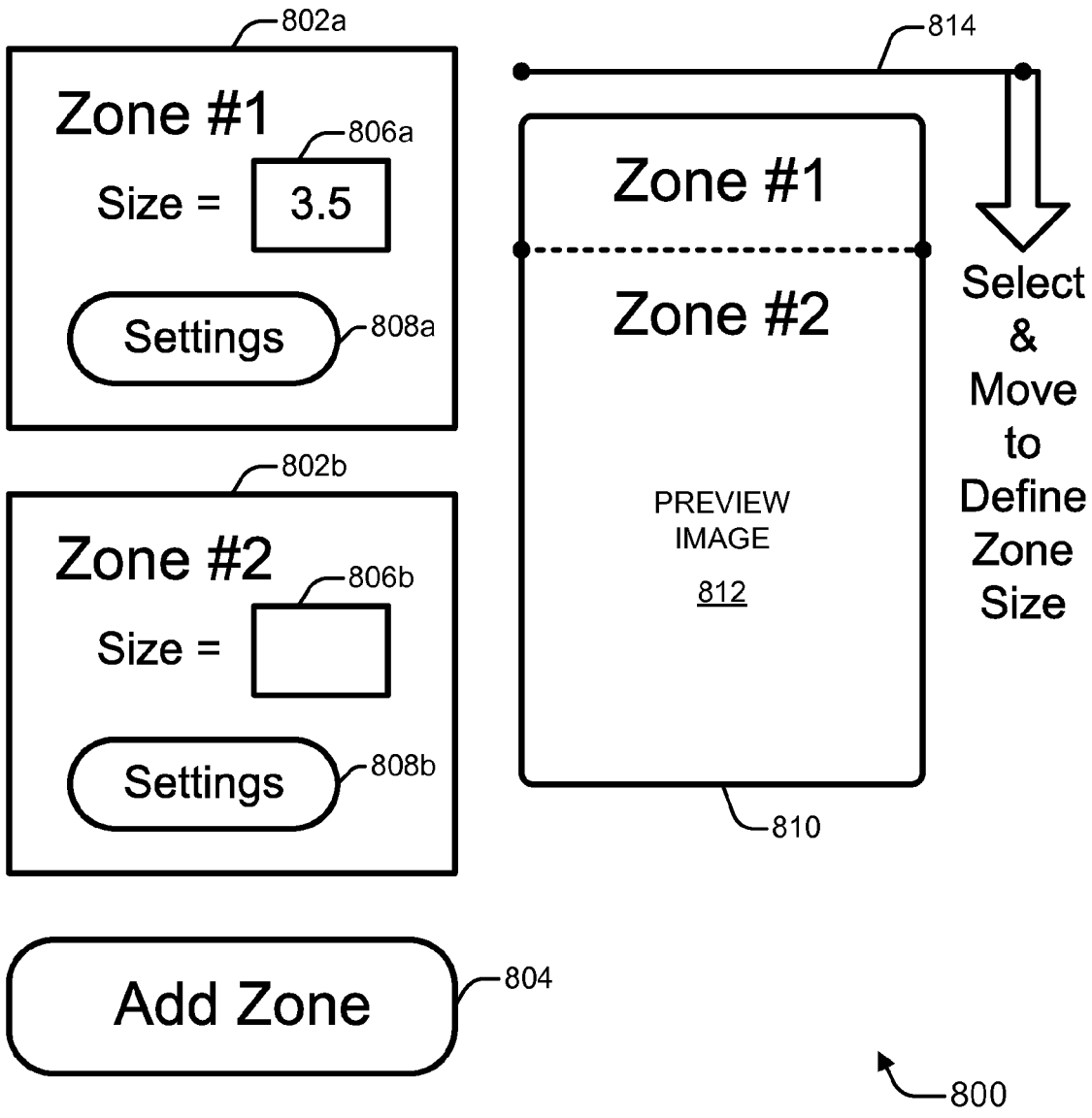
FIG. 8 is a block diagram of an example user interface that enables a user to establish multiple zones that are defined by at least one size indicator.

FIG. 8 is a block diagram of an example user interface 800 that enables a user to establish multiple zones that are defined by at least one size indicator. User interface 800 may, for example, be part of a window for setting up printing, a window pane, a tab, some combination thereof, and the like. User interface 800 may be produced by an imaging device driver, an application plug-in for an imaging device, a combination thereof, and the like that is executing on a computing device. Alternatively, user interface 800 may be produced by an imaging device and displayed on a screen implementation of an I/O interface of the imaging device.

Regardless, in addition to specific, case-by-case (e.g., print-job-by-print-job) zone creation and EP engine settings entry by a user, the user may establish one or more profiles. The profiles may then be loaded into or otherwise activated by an imaging driver, by an application plug-in (e.g., including a standard module or an after-market module for a word processor, a portable document format (PDF) processor, and the like), by a controller of an imaging device, some combination thereof, and the like. Each profile may pre-establish a set of zones that may be selected together by selecting the profile. The user can then enter EP engine settings on a case-by-case basis for one or more of the pre-established zones, or the profile may include the EP engine settings as well as zone size indicators. A given profile may also include a group of EP engine settings that may be selected together for association to respective zones that have been defined by the user. Furthermore, a profile may include both a set of zones and a group of EP engine settings that may be jointly selected by activating a single profile.

As illustrated, example user interface 800 is roughly divided into two portions: a left side and a right side. Although both left and right sides are shown for user interface 800 of FIG. 8, a user interface may alternatively include the elements of but one of the two sides (and/or other non-illustrated UI elements). The elements may also be rearranged or otherwise modified.

In an example embodiment, the left side includes zone definition boxes 802*a* and 802*b*. The left side enables new zones to be added using an "Add Zone" button 804. The left side also enables zone size to be defined using size entry boxes 806*a* and 806*b* to establish at least one size indicator for the associated zone. Each respective zone definition box 802*a* and 802*b* includes a respective settings button 808*a* and 808*b* that activates a popup window/box or similar that enables selection of the particular EP engine settings that are desired for the associated zone. Which size entry boxes 806*a* and/or 806*b* are to include a size indicator depends on how the zones are being defined (e.g., with a beginning boundary, with an ending boundary, with both boundaries, and the like.

The right side includes a representation 810 of a page of media to be printed. It provides a graphical user interface (GUI) scheme for defining zone boundaries and/or adding new zones. Representation 810 may also include a, e.g. miniaturized, preview image 812 that is to be printed. Preview image 812 can facilitate the creation and/or sizing of zones based on displayed image portions (e.g., textual blocks, photos, coloring, other image objects or traits thereof, and the like). In operation, a user is empowered to select a zone boundary icon 814 and move it (including a copy/version thereof) to a desired position on preview image 812 of representation 810. This movement defines a zone size indicator and can also be used to create a new zone. By way of example only, with a mouse interface, a user may click zone boundary icon 814 and drag it to a desired position. Selection and movement of zone boundary icon 814 may alternatively be effectuated through cursor arrow keys, a touch screen interface, and the like. The entering of EP engine settings may also be enabled by selecting the area corresponding to a zone on representation 810 to precipitate presentation of a pop-up window/box or the like. Although not illustrated in FIG. 8, such a user interface 800 may also facilitate zone creation and sizing in a perpendicular direction (e.g., a "vertical" zone boundary icon may be included on the right side).

Figure 9:
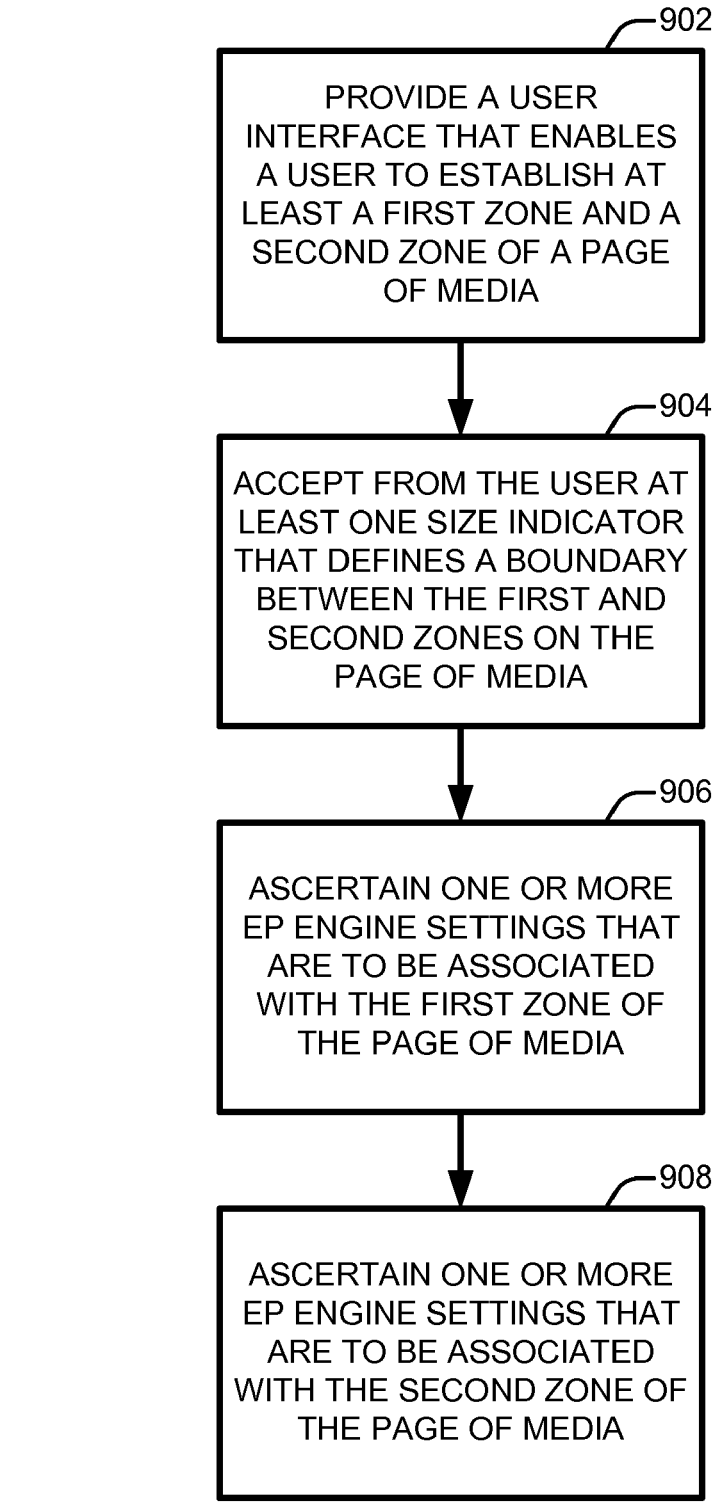
FIG. 9 is a flow diagram of an example method for applying respective EP engine settings to different zones within a page of media in the context of a user interface, such as that of FIG. 8.

FIG. 9 is a flow diagram 900 of an example method for applying respective EP engine settings to different zones within a page of media in the context of a user interface, such as the one shown in FIG. 8. As illustrated, flow diagram 900 includes four blocks 902, 904, 906, 908. At block 902, a user interface is provided that enables a user to establish at least a first zone and a second zone of a page of media. For example, a user interface 800 may be provided to a user at a computing device and/or at an imaging device, and the user may be empowered to partition a page of media into at least two zones.

At block 904, at least one size indicator is accepted from the user, with the size indicator defining a boundary of at least one zone of the page of media. For example, at least one size indicator to define a boundary between first and second zones may be accepted from the user via a size entry box 806*a*, 806*b* and/or a zone boundary icon 814. In this instance, at least the ending of the first zone or the beginning of the second zone is defined, which may be considered as equivalent when the first and second zones are next to each other.

At block 906, one or more EP engine settings, which are to be associated with the first zone of the page of media, are ascertained. For example, the EP engine settings for the first zone may be ascertained after the user selects settings button 808*a* and/or the area of representation 810 that corresponds to the first zone. At block 908, one or more EP engine settings, which are to be associated with the second zone of the page of media, are ascertained. For example, the EP engine settings for the second zone may be ascertained after the user selects settings button 808*b* and/or an area of representation 810 that corresponds to the second zone.

Figure 10:
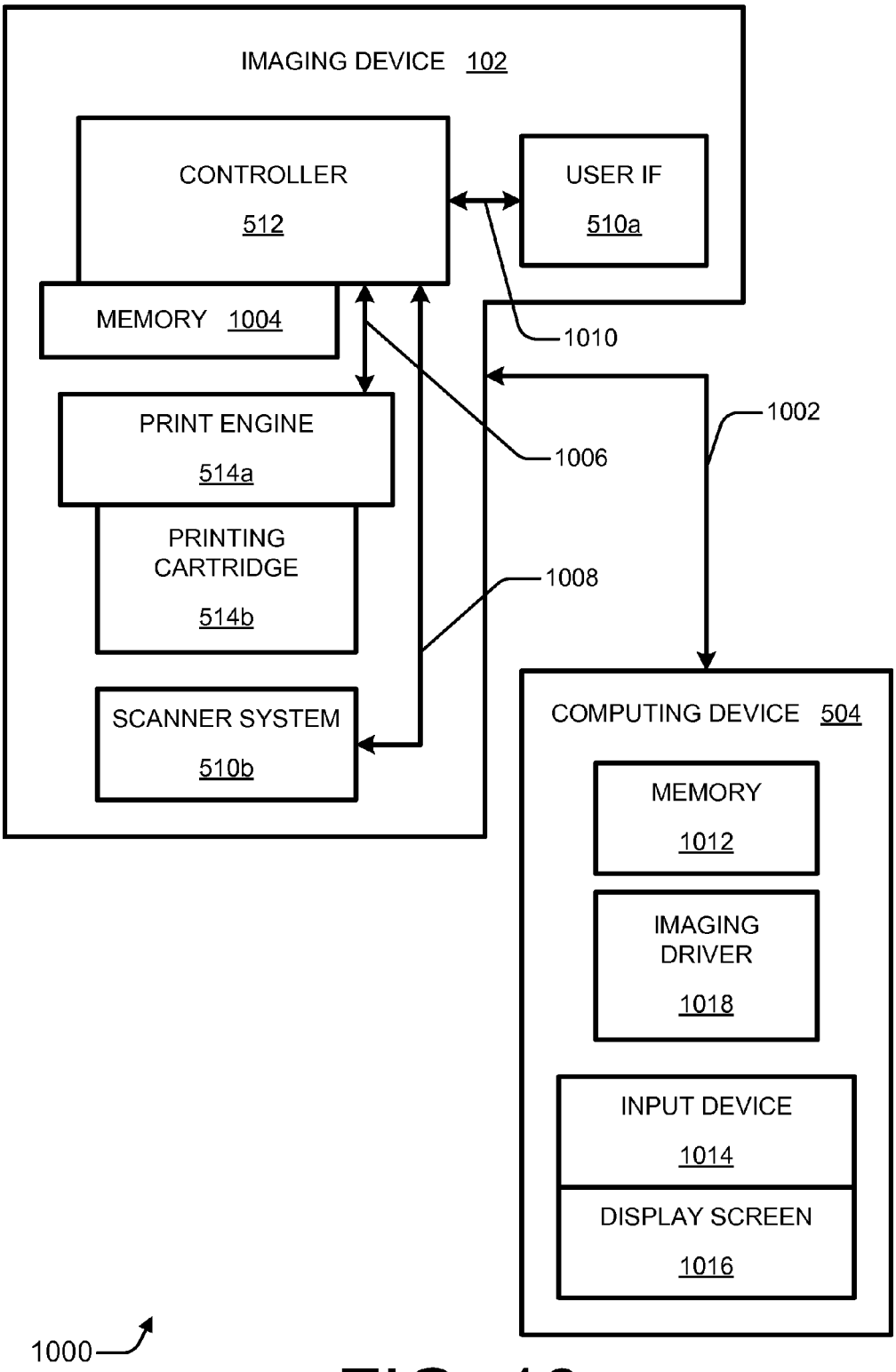
FIG. 10 is a diagrammatic depiction of an example imaging system in which applying respective print settings (e.g., EP engine settings) to different zones within a page of media may be implemented.

FIG. 10 is a diagrammatic depiction of an example imaging system 1000 in which applying respective print settings (e.g., EP engine settings) to different zones within a page of media may be implemented. As illustrated, imaging system 1000 may include an imaging device 102 and a computing device 504. In an example embodiment, imaging device 102 communicates with computing device 504 via a communications link 1002. As used herein, the term "communications link" refers generally to a structure that facilitates electronic communication between multiple components, and it may operate using wired or wireless technology. Imaging system 1000 may be, for example, a customer imaging system, or alternatively, a development tool used in imaging apparatus design.

Imaging device 102 is shown as an example multifunction machine. It includes some specific example component implementations for the more general components shown in FIG. 5. Imaging device 102 includes a controller 512, a print engine 514*a*, a printing cartridge 514*b*, a scanner system 510*b*, and a user interface 510*a*. Imaging device 102 may communicate with computing device 504 via a standard communication protocol, such as for example, universal serial bus (USB), Ethernet, IEEE 802.xx, a combination thereof, and the like. A multifunction machine is also sometimes referred to in the art as an all-in-one (AIO) unit. Those skilled in the art will recognize that imaging device 102 may be, for example, an ink jet printer/copier; an EP printer/copier; a thermal transfer printer/copier; and other devices such as at least scanner system 510*b* (or a standalone scanner system 510*b*), a fax machine, combinations thereof; and the like.

Controller 512 may include and/or be realized as one or more processor units (not separately shown in FIG. 10) and at least one associated memory 1004, and it may also be formed as one or more Application Specific Integrated Circuits (ASIC). Memory 1004 may be, for example, random access memory (RAM), read only memory (ROM), and/or non-volatile RAM (NVRAM), a combination thereof, and the like. Alternatively, memory 1004 may be in the form of a separate electronic memory (e.g., RAM, ROM, NVRAM, flash memory), a hard drive, a CD or DVD drive, or any memory device convenient for use with controller 512. Controller 512 may be, for example, a combined printer, copier, fax, and scanner controller, or it may be a combination of one or more separate controllers.

In an example implementation, controller 512 communicates with print engine 514*a* (e.g., an EP print engine) via a communications link 1006. Controller 512 communicates with scanner system 510*b* via a communications link 1008. User interface 510*a* is communicatively coupled to controller 512 via a communications link 1010. Controller 512 serves to process printing information (including print data) and to operate print engine 514*a* during printing, as well as to operate scanner system 510*b* and to process data obtained via scanner system 510*b*. In addition, controller 512 may operate in conjunction with print engine 514*a* and/or printing cartridge 514*b* when applying different print settings (e.g., EP engine settings) to different zones of a page of media. Although the example print mechanism components 514*a* and 514*b* of image device 102 in FIG. 10 pertain to an EP printing process, the principles may be applied to other printing processes.

Computing device 504 may be present and, if so, coupled to imaging device 102 via communication link 1002. Computing device 504 may be, for example, a personal or server computer. As illustrated, computing device 504 includes memory 1012, such as RAM, ROM, NVRAM, and/or flash memory; an input device 1014, such as a keyboard; and a display screen 1016. Although not explicitly shown in FIG. 10, computing device 504 may further include at least one processor, one or more I/O interfaces, and at least one mass data storage device, such as a hard drive or an optical disk unit.

In an example embodiment, computing device 504 includes in its memory 1012 a program having processor-executable instructions that function as an imaging driver 1018. Imaging driver 1018 may comprise, e.g., printer/scanner/copier/fax driver software for imaging device 102. Imaging driver 1018 is in communication with controller 512 of imaging device 102 via communications link 1002. Imaging driver 1018 facilitates communication between imaging device 102 and computing device 504. One aspect of imaging driver 1018 may be, for example, to provide formatted print data (e.g., as part of printing information 508 (of FIG. 5)) to imaging device 102, and more particularly to print engine 514*a*, to print an image. Another aspect of imaging driver 1018 may be, for example, to facilitate collection of print settings (e.g., EP engine settings) that are input by a user via input device 1014 of computing device 504. Alternatively, such functionality by computing device 504 may be realized with an application plug-in corresponding to imaging device 102.

In some circumstances, it may be desirable to operate imaging device 102 in a standalone mode. In such a standalone mode, imaging device 102 is capable of functioning without computing device 504. Accordingly, all or a portion of imaging driver 1018, or a driver/program with similar functionality, may be located in controller 512 (including in memory 1004) of imaging device 102 so as to accommodate printing (and scanning, faxing, and copying) functionality when operating in the standalone mode. Especially in such a standalone mode, imaging device 102 may be capable of presenting any portion of user interface 800 (of FIG. 8) via user interface 510*a*.

Figure 11:
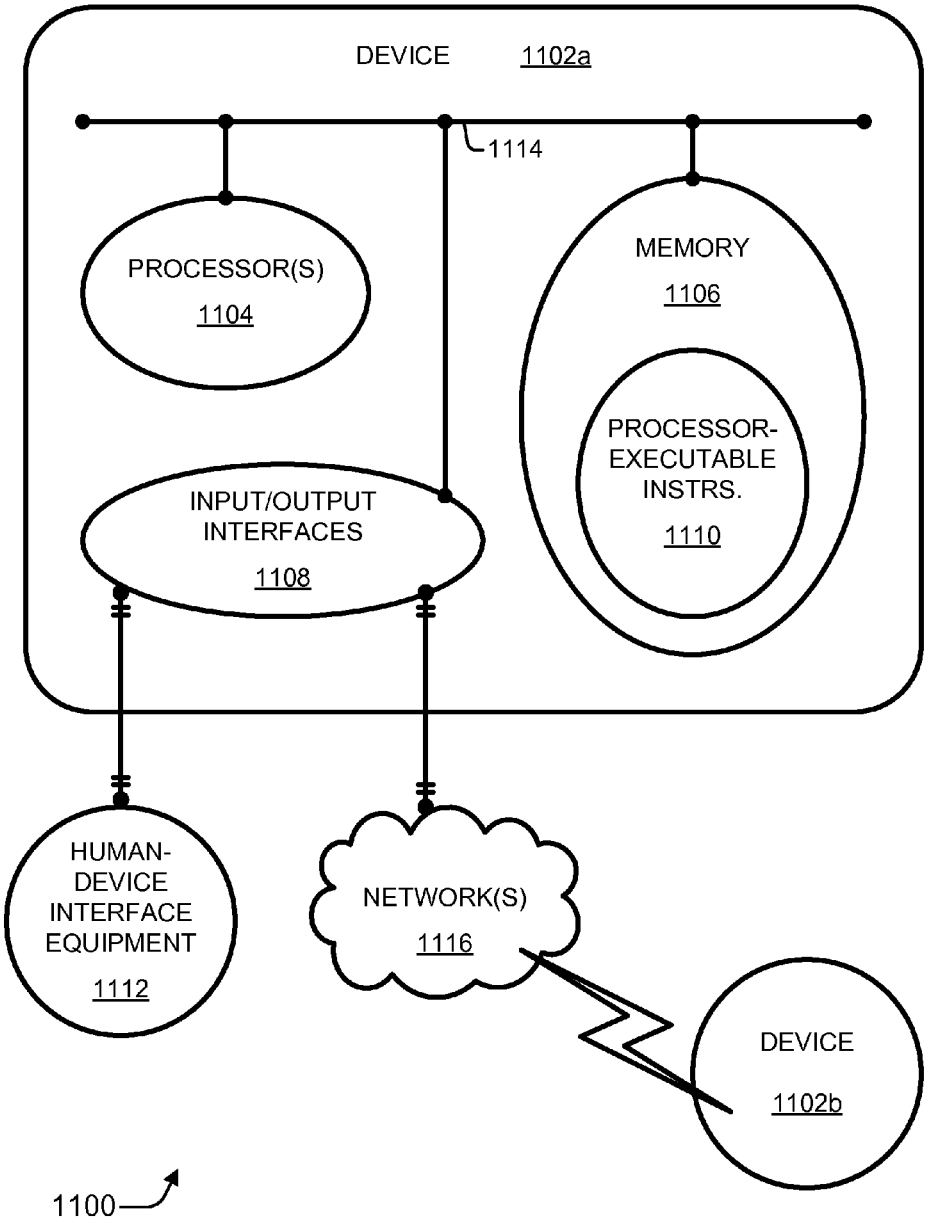
FIG. 11 is a block diagram of example devices from a component perspective that may be used to implement embodiments for applying respective print settings (e.g., EP engine settings) to different zones within a page of media.

FIG. 11 is a block diagram 1100 of example devices that may be used to implement embodiments for applying respective print settings (e.g., EP engine settings) to different zones within a page of media. As illustrated, block diagram 1100 includes two devices 1102*a* and 1102*b*, human-device interface equipment 1112, and one or more networks 1116. As explicitly shown with device 1102*a*, each device may include at least one processor 1104, one or more memories 1106, one or more input/output interfaces 1108, and at least one interconnection 1114. Memory 1106 may include processor-executable instructions 1110. Network(s) 1116 may be, by way of example but not limited to, an internet, an intranet, an Ethernet, a public network, a private network, a cable network, a digital subscriber line (DSL) network, a telephone network, a wired network, a wireless network, some combination thereof, and the like. Device 1102*a* and device 1102*b* may communicate over network(s) 1116.

In example embodiments, the device may represent any processing-capable device. Example device implementations include, but are not limited to, an imaging device 102, a computing device 504, some combination thereof, and the like. Processor 1104 may be implemented using any applicable processing-capable technology, and one may be realized as a general-purpose or a special-purpose processor. Examples include, but are not limited to, a central processing unit (CPU), a digital signal processor (DSP), a microprocessor, some combination thereof, and the like. Memory 1106 may be any available memory that is included as part of and/or is accessible by the device. It may include volatile and non-volatile memory, removable and non-removable memory, hard-coded logic, combinations thereof, and the like.

Interconnection 1114 interconnects the components of the device. Interconnection 1114 may be realized as a bus or other connection mechanism and may directly or indirectly interconnect various components. I/O interfaces 1108 (e.g., I/O interface 510 of FIG. 5) may include (i) a network interface for monitoring and/or communicating across network 1116, (ii) a display device interface for displaying information on a display screen, (iii) one or more human-device interfaces, and the like. Example network interfaces include, but are not limited to, a radio or transceiver (e.g., a transmitter and/or a receiver), a modem, a network card, some combination thereof, and the like. Human-device interface equipment 1112 may be integrated with or discrete from the device. Examples of human-device interface equipment 1112 (e.g., user interface 510*a* of FIG. 10) include, but are not limited to, keyboards and/or keypads; screens for images (including touch-sensitive screens); combinations thereof, and the like. Human-device interface equipment 1112 may also serve as I/O interfaces 1108.

Generally, processor 1104 is capable of executing, performing, and/or otherwise effectuating processor-executable instructions, such as processor-executable instructions 1110. Memory 1106 is comprised of one or more processor-accessible memories. In other words, memory 1106 may include processor-executable instructions 1110 that are executable by processor 1104 to effectuate the performance of functions by the device. Processor-executable instructions 1110 may be embodied as software, firmware, hardware, fixed logic circuitry, some combination thereof, and the like. Processor 1104 and processor-executable instructions 1110 of memory 1106 may be realized separately (e.g., as a DSP executing code) or integrated (e.g., as part of an application-specific integrated circuit (ASIC)).

In example implementations, one device may comprise an imaging device 102, and another device may comprise a computing device 504. When processor-executable instructions 1110 are executed by processor 1104, the functions that are described herein may be effectuated. Example functions include, but are not limited to, those that are illustrated by flow diagrams 400, 700, and 900 (of FIGS. 4, 7, and 9); those that are represented by the example pages of media 104 (of FIGS. 1, 2A, 2B and 3A-3C); those that enable the features of user interface 800 (of FIG. 8); as well as those that are embodied by the other features that are described herein.

The blocks of the illustrated flow diagrams (e.g., flow diagrams 400, 700, and 900 of FIGS. 4, 7, and 9, respectively) may be effectuated with processor-executable instructions. Processor-executable instructions may be embodied as hardware, firmware, software, fixed logic circuitry, combinations thereof, and the like. Example operational implementations of processor-executable instructions include, but are not limited to, a memory coupled to a processor, an ASIC, a digital signal processor and associated code, some combination thereof, and the like. Although each of the methods of the illustrated flow diagrams are shown and described in a particular example order, the acts thereof may alternatively be performed in other orders, as well as in a fully or partially overlapping manner.

The devices, features, functions, methods, acts, schemes, procedures, components, zones, and the like of FIGS. 1-11 are illustrated in diagrams that are divided into multiple blocks and other elements. However, the order, interconnections, interrelationships, layout, and the like in which FIGS. 1-11 are described and/or shown are not intended to be construed as limiting, for any number of the blocks and/or other elements may be modified, combined, rearranged, augmented, omitted, and the like in many manners to implement one or more systems, methods, devices, memories, apparatuses, arrangements, and the like for applying respective EP engine settings to different zones within a page of media.

Although multiple embodiments have been illustrated in the accompanying Drawings and described in the foregoing Detailed Description, it should be understood that the invention is not limited to the disclosed embodiments, for it is also capable of numerous rearrangements, modifications, and substitutions without departing from the scope of the invention as set forth and defined by the following claims.

What is claimed is:

1. An imaging device that is capable of applying respective electrophotographic (EP) engine settings to different zones within a page of media, the imaging device comprising:

at least one input interface to receive printing information for a page of media, the printing information including a size indicator for at least one zone of multiple zones within the page of media and one or more respective EP engine settings for the multiple zones within the page of media;

a print mechanism to print on the page of media; and a controller that is to utilize the printing information to print on the page of media by controlling the print mechanism, the controller to cause the print mechanism to print on the page of media in a first zone using a first EP engine setting and to print on the page of media in a second zone using a second EP engine setting, and the controller to establish a boundary between the first zone and the second zone responsive to the size indicator.

2. The imaging device as recited in claim 1, wherein the size indicator comprises at least one distance on the page of media.

3. The imaging device as recited in claim 2, wherein the at least one distance on the page of media comprises at least one distance that is measured relative to an edge of the page of media or relative to a boundary for a zone of the multiple zones.

4. The imaging device as recited in claim 1, wherein the controller is to convert the size indicator into a distance indicator on the page of media that is in a type of units that is understood by the print mechanism.

5. The imaging device as recited in claim 1, wherein the first EP engine setting comprises multiple user-perceived EP engine settings that are associated with the first zone; and wherein the controller is to convert the multiple user-perceived EP engine settings into at least one print mechanism EP engine setting.

6. The imaging device as recited in claim 1, wherein the first EP engine setting comprises a first laser intensity level, and the second EP engine setting comprises a second laser intensity level.

7. The imaging device as recited in claim 1, wherein the first EP engine setting comprises a first transfer voltage level, and the second EP engine setting comprises a second transfer voltage level.

8. The imaging device as recited in claim 1, wherein the first EP engine setting comprises a first fuser temperature, and the second EP engine setting comprises a second fuser temperature.

9. The imaging device as recited in claim 1, wherein the controller is to cause the print mechanism to operate in a first resolution mode in the first zone and in a second resolution mode in the second zone.

10. The imaging device as recited in claim 1, wherein the input interface comprises a manual input/output (I/O) interface that enables a user to directly enter at the imaging device at least the size indicator for the at least one zone of the multiple zones within the page of media.

11. The imaging device of claim 1, wherein the one or more EP engine settings for the first and second zones comprises at least one of darkness/lightness settings, media thickness settings, media weight settings, media texture settings, print quality settings, and visual resolution settings.

12. The imaging device of claim 1, wherein the one or more EP engine settings for the first and second zones requires a change in at least one of laser intensity level, transfer voltage level, fuser temperature, dots per inch (DPI), developer roll voltage, and charge roll voltage.

13. The imaging device of claim 1, wherein the print mechanism includes an EP engine, and the boundary between the first zone and the second zone is parallel with a process direction and perpendicular to a scan direction of the EP engine.

14. The imaging device of claim 1, wherein the at least one size indicator comprises a first size indicator that is relative to a first edge of the page of media and a second size indicator that is relative to a second edge thereof that is not opposite the first edge, and at least one of the first zone and the second zone is defined at least in part by the first size indicator and the second size indicator.

15. A method that is implemented by an imaging device that is capable of applying respective electrophotographic (EP) engine settings to different zones within a page of media, the method comprising:

printing in a first zone on a page of media based on a first EP engine setting that is associated with the first zone;

switching from the first zone on the page of media to a second zone on the page of media responsive to a size indicator; and printing in the second zone on the page of media based on a second EP engine setting that is associated with the second zone;

wherein the switching comprises adjusting an operation of a print mechanism to accommodate a switching from the first EP engine setting to the second EP engine setting as the page of media is advanced to a distance corresponding to the size indicator.

16. The method as recited in claim 15, further comprising:

converting at least one first user-perceived EP engine setting that is associated with the first zone into at least one first print mechanism EP engine setting that is associated with the first zone; and converting at least one second user-perceived EP engine setting that is associated with the second zone into at least one second print mechanism EP engine setting that is associated with the second zone.

17. The method as recited in claim 15, wherein the first and second EP engine settings comprise at least one of darkness/ lightness settings, media thickness settings, media weight settings, media texture settings, print quality settings, and visual resolution settings.

18. The method as recited in claim 15, wherein the first and second EP engine settings require a change in at least one of laser intensity level, transfer voltage level, fuser temperature, dots per inch (DPI), developer roll voltage, and charge roll voltage of the imaging device.

19. One or more processor-accessible storage media having processor-executable instructions to facilitate applying respective electrophotographic (EP) engine settings to different zones within a page of media, wherein the processor-executable instructions, when executed, configure a device to perform acts comprising:

provide a user interface that enables a user to establish at least a first zone and a second zone of a page of media;

accept from the user at least one size indicator that defines a boundary between the first zone and the second zone on the page of media;

ascertain one or more EP engine settings that are to be associated with the first zone of the page of media by at least one of accessing a stored profile of EP engine settings, enabling a user to input a first darkness setting for the first zone of the page of media, and enabling a user to input a first media type for the first zone of the page of media; and ascertain one or more EP engine settings that are to be associated with the second zone of the page of media by enabling a user to input at least one of a second darkness setting and a second media type for the second zone of the page of media.

20. The one or more processor-accessible storage media as recited in claim 19, wherein the processor-executable instructions comprise (i) at least part of a driver for an image device, (ii) at least part of an application plug-in corresponding to an image device, or (iii) at least part of control instructions that operate an image device.

21. The one or more processor-accessible storage media as recited in claim 19, wherein the processor-executable instructions, when executed, configure the device to accept from the user the at least one size indicator that defines a boundary between the first zone and the second zone on the page of media by accepting a numerical input that defines a distance on the page of media for the boundary between the first zone and the second zone.

22. The one or more processor-accessible storage media as recited in claim 19, wherein the processor-executable instructions, when executed, configure the device to accept from the user the at least one size indicator that defines a boundary between the first zone and the second zone on the page of media by accepting a graphical user interface (GUI) input that corresponds to a graphical movement of a boundary line between the first zone and the second zone on a display to represent movement of the boundary between the first zone and the second zone on the page of media.

23. The one or more processor-accessible storage media as recited in claim 19, wherein the processor-executable instructions, when executed, configure the device to ascertain the one or more EP engine settings that are to be associated with the first zone of the page of media by accessing the stored profile of EP engine settings.

24. The one or more processor-accessible storage media as recited in claim 19, wherein the processor-executable instructions, when executed, configure the device to:

ascertain the one or more EP engine settings that are to be associated with the first zone of the page of media by enabling the user to input the first darkness setting for the first zone of the page of media; and ascertain the one or more EP engine settings that are to be associated with the second zone of the page of media by enabling the user to input the second darkness setting for the second zone of the page of media.

25. The one or more processor-accessible storage media as recited in claim 19, wherein the processor-executable instructions, when executed, configure the device to:

ascertain the one or more EP engine settings that are to be associated with the first zone of the page of media by enabling the user to input the first media type for the first zone of the page of media; and ascertain the one or more EP engine settings that are to be associated with the second zone of the page of media by enabling the user to input the second media type for the second zone of the page of media.

26. The one or more processor-accessible storage media as recited in claim 19, wherein the device comprises an imaging device having an EP engine, and the boundary between the first zone and the second zone is parallel with a process direction and perpendicular to a scan direction of the EP engine.

27. The one or more processor-accessible storage media as recited in claim 19, wherein the at least one size indicator comprises a first size indicator that is relative to a first edge of the page of media and a second size indicator that is relative to a second edge thereof, and at least one of the first zone and the second zone is defined at least in part by the first size indicator and the second size indicator.

28. One or more processor-accessible storage media having processor-executable instructions to facilitate applying respective electrophotographic (EP) engine settings to different zones within a page of media, wherein the processor-executable instructions, when executed, configure a device to perform acts comprising:

provide a user interface that enables a user to establish at least a first zone and a second zone of a page of media and at least one size indicator that defines a boundary between the first zone and the second zone on the page of media;

ascertain one or more EP engine settings that are to be associated with the first zone of the page of media;

ascertain one or more EP engine settings that are to be associated with the second zone of the page of media; and configure a device to accept from the user the at least one size indicator that defines the boundary by accepting one of a numerical input that defines a distance from an edge of the page of media to the boundary and a graphical user interface (GUI) input that corresponds to a graphical movement of a boundary line between the first zone and the second zone on a display to represent movement of the boundary.

29. The one or more processor-accessible storage media as recited in claim 28, wherein the processor-executable instructions, when executed, configure the device to accept from the user the at least one size indicator that defines the boundary between the first zone and the second zone on the page of media by accepting the numerical input that defines the distance on the page of media for the boundary between the first zone and the second zone.

30. The one or more processor-accessible storage media as recited in claim 28, wherein the processor-executable instructions, when executed, configure the device to accept from the user the at least one size indicator that defines the boundary between the first zone and the second zone on the page of media by accepting the graphical user interface (GUI) input that corresponds to the graphical movement of the boundary line between the first zone and the second zone on the display to represent movement of the boundary between the first zone and the second zone on the page of media.

31. One or more processor-accessible storage media having processor-executable instructions to facilitate applying respective electrophotographic (EP) engine settings to different zones within a page of media, wherein the processor-executable instructions, when executed, configure a device to perform acts comprising:

provide a user interface that enables a user to establish at least a first zone and a second zone of a page of media;

accept from the user at least one size indicator that defines a boundary between the first zone and the second zone on the page of media;

ascertain one or more EP engine settings that are to be associated with the first zone of the page of media; and ascertain one or more EP engine settings that are to be associated with the second zone of the page of media;

wherein the processor-executable instructions, when executed, configure the device to at least one of ascertain the one or more EP engine settings that are to be associated with the first zone of the page of media by accessing the stored profile of EP engine settings and ascertain the one or more EP engine settings that are to be associated with the first zone of the page of media by enabling the user to input the first darkness setting for the first zone of the page of media.

32. The one or more processor-accessible storage media as recited in claim 31, wherein the processor-executable instructions, when executed, configure a device to perform acts comprising ascertain the one or more EP engine settings that are to be associated with the first zone of the page of media by accessing the stored profile of EP engine settings.

33. The one or more processor-accessible storage media as recited in claim 31, wherein the processor-executable instructions, when executed, configure a device to perform acts comprising ascertain the one or more EP engine settings that are to be associated with the first zone of the page of media by enabling the user to input the first darkness setting for the first zone of the page of media.

* * * * *